US006489964B1

(12) United States Patent
Van Asma

(10) Patent No.: US 6,489,964 B1
(45) Date of Patent: Dec. 3, 2002

(54) MEMORY ARRANGEMENT

(75) Inventor: Cornelis G. M. Van Asma, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/344,232

(22) Filed: Jun. 25, 1999

(30) Foreign Application Priority Data

Jun. 30, 1998 (EP) ..... 98202196

(51) Int. Cl.[7] ..... G09G 5/36
(52) U.S. Cl. ..... 345/545; 345/560; 345/660
(58) Field of Search ..... 345/545, 530, 345/560, 536, 660, 501; 382/298, 305

(56) References Cited

U.S. PATENT DOCUMENTS 5,142,637 A 8/1992 Harlin et al. ..... 395/425
5,257,103 A * 10/1993 Vogeley et al. ..... 348/448
5,615,376 A * 3/1997 Ranganathan ..... 345/501
6,189,064 B1 * 2/2001 MacInnis et al. ..... 345/440

FOREIGN PATENT DOCUMENTS

WO 9734285 A1 9/1997

OTHER PUBLICATIONS

"Frame Buffer Wars: New Directions in PC Graphics", by David Kocsis, EDN Design Feature, May 23, 1996, pp. 121–128.

* cited by examiner

*Primary Examiner*—Kee M. Tung
(74) *Attorney, Agent, or Firm*—Laurie E. Gathman

(57) ABSTRACT

In a memory arrangement including a frame buffer unit (FB) having memory equipment (SDRAM) clocked by a memory clock (fm), and a scaler unit (S), the scaler unit (S) has at least one line memory (inplinmem, outplinmem) for converting a continuous input data stream into a frame buffer data stream in which samples of two successive data bursts of N samples are situated N+ΔN samples apart from each other, and/or for converting such a frame buffer data stream into a continuous output data stream, to allow the frame buffer unit (FB) to operate with less than three different clocks.

10 Claims, 2 Drawing Sheets

MEMORY ARRANGEMENT

BACKGROUND OF THE INVENTION

1. Field of the Invention

The invention relates to a memory arrangement comprising a frame buffer unit comprising memory equipment clocked by a memory clock, and a scaler unit.

2. Description of the Related Art

The most suitable random access memory (RAM) device for a frame buffer is Synchronous Dynamic RAM (SDRAM). This type of memory is used in large quantities for graphics controllers. The conventional SDRAM devices are single port devices. This means that time multiplexing is required if a continuous stream of data needs to be written into and read from the SDRAM. For digital video, normally 8 bits per color are used. The typical data width of commercially available SDRAM devices is 16 bits. Furthermore, SDRAM devices are available that can run on the sampling frequency of the incoming video. Furthermore, the memory size of these devices is large enough to store the video samples of one field for one color. With these memories, the frame buffer can be realized using three SDRAM devices, where each color requires one SDRAM device. To obtain a high data rate, the SDRAM needs to be addressed in a burst mode. The burst length is in general a power of 2 (e.g., 2, 4, 8, 16, etc.). This means that at the input and output of the frame buffer, first-in, first-out (FIFO) memories are required. During a burst, two samples are read from or written into the memory in parallel. This means that at the input and output, a multiplexer is required.

For simplicity, it will be assumed that half of the available time is used to write incoming data into the SDRAM where the other half is used to read data from the SDRAM. Furthermore, the input FIFO and output FIFO should be as small as possible which means that a read burst should interleave with a write burst. In order to address the memory correctly, some addressing overhead is required. This means that for a burst transfer of N samples, ΔN additional clock cycles are required for each burst. This means that the data throughput of the SDRAM needs to be larger than the sum of the input and output data throughput. To solve this problem in the frame buffer itself, the following solutions are applicable: increase the number of SDRAMs, use large input and output FIFOs, or increase the clock frequency. The first solution is not attractive because this will increase the costs and pin count of the frame buffer. The second solution works as follows. Since only the active video data needs to be stored into the frame buffer, no data is written during horizontal blanking time. When large input and output FIFOs are used, the horizontal blanking time can compensate for the addressing overhead. As mentioned in the introduction, it is desired to use a gate array design for the frame buffer controller. In a gate array, it is not realistic to implement this kind of large memories. The third solution is increasing the clock frequency of the SDRAM. For simplicity, it was assumed that read bursts are interleaved with write bursts. In that case the memory clock frequency should satisfy $$fm = \max\left(\frac{\Delta N + N}{N} \cdot fin,\ \frac{\Delta N + N}{N} \cdot fout\right)$$

In this case, it can be computed that it is sufficient to use input and output FIFOs that can store 2N samples. A disadvantage of this system is that this concept requires three different clocks (viz. an input clock fin, a frame buffer memory clock fm, and an output clock fout) which makes the design of such a frame buffer more difficult. Furthermore, it is less attractive from an integration point of view. Especially when these clocks are generated by a PLL, additional circuitry is necessary.

SUMMARY OF THE INVENTION

It is, inter alia, an object of the invention to allow the frame buffer unit to operate with less than three different clocks. To this end, a first aspect of the invention provides a memory arrangement having a scaler unit and a frame buffer unit. Another aspect of the invention provides; a display apparatus including such a memory arrangement. Further aspects of the invention provide; ICs and frame buffer unit ICs which are preferably applied in a memory arrangement in accordance with the present invention.

In a memory arrangement comprising a frame buffer unit comprising memory equipment clocked by a memory clock, and a scaler unit, in accordance with a primary aspect of the invention, the scaler unit comprises at least one line memory for converting a continuous input data stream into a frame buffer data stream in which samples of two successive data bursts of N samples are situated N+ΔN samples apart from each other, and/or for converting such a frame buffer data stream into a continuous output data stream.

These and other aspects of the invention will be apparent from and elucidated with reference to the embodiments described hereinafter.

DESCRIPTION OF THE PREFERRED EMBODIMENTS

A primary aspect of this invention describes a smart interface between a scaler IC and a frame buffer IC to implement a burst mode data transfer between a scaler and a frame buffer. Many matrix displays require both a scaler and frame buffer function. Most matrix displays require a custom design for the frame buffer. The frame buffer function is also different for the various types of matrix displays. The scaler, however, does not need to be display specific. Furthermore, the scaler requires several line memories, which requires an expensive standard cell design for the scaler. In contrast to the scaler, a cheap gate array process can be used for the frame buffer. A first aspect of this invention describes a specific smart interface between the scaler IC and the frame buffer IC which has a lot of advantages. The main advantage is that the design of the frame buffer is much easier because a single clock concept can be used without the need of additional memory. With a single clock concept for the frame buffer, the number of phase-locked loops (PLL) is minimized. This is an advantage for electro-magnetic compatibility (EMC) and, in case external PLLs are used, a higher degree of integration can be obtained. Without this smart interface, a single clock system normally requires an additional frame memory in order to increase the data bandwidth of the SDRAM.

Figure 1:
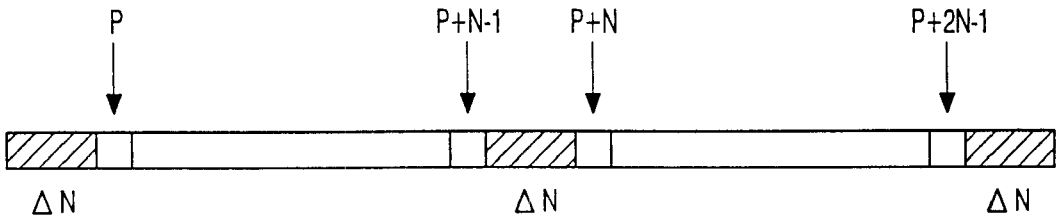
FIG. 1 shows a desired output format of a scaler.

One aspect of this invention is based on the recognition that a frame buffer is also used for other functions like bit-mapped on-screen display (OSD), color sequential output for a digital mirror device (DMD) display, and sub-field modulation which is required for plasma and DMD displays. For these type of functions the scaler needs to be placed before the frame buffer. The idea of this invention is that the line memories in the scaler can be used to produce a special output. FIG. 1 shows the desired output format. The samples P.P+N−1 belong to a first burst, and the samples P+N, P+2N−1 belong to a second burst. The samples of two successive bursts are situated N+ΔN samples apart from each other. Due to the line memory, the input clock does not need to be connected anymore to the frame buffer controller, While the size of the input FIFO does not need to be changed. In a preferred embodiment in which the read enable signal RE of the line memory is controlled from the frame buffer, it is even possible to use a smaller FIFO. It can be computed that in that case, a FIFO that can store N samples is sufficient.

Figure 2:
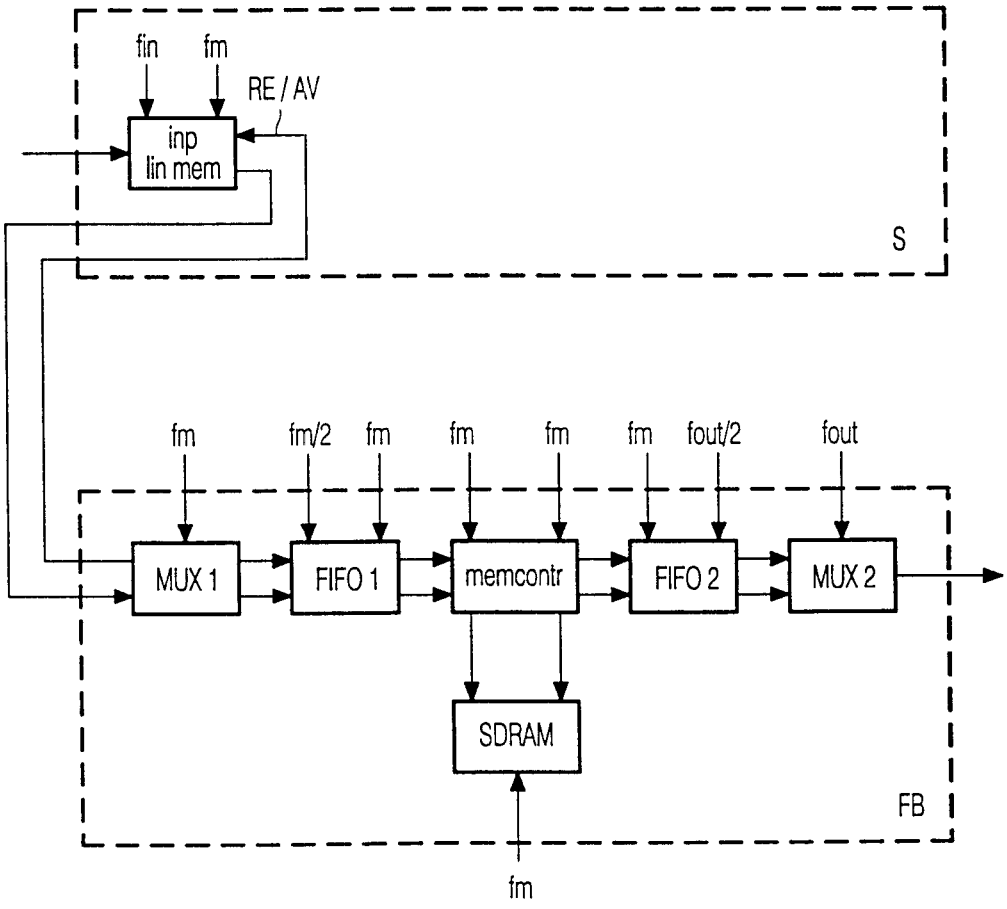
FIG. 2 shows an embodiment of the present invention.

FIG. 2 shows a first embodiment of the invention. A read enable signal RE of an input line memory inplinmem of a scaler S is controlled by a signal coming from a demultiplexer MUX1 in a frame buffer FB. However, in a preferred alternative implementation, an active video indication signal AV is sent from the input line memory inplinmem to the frame buffer FB, as then the control signal AV and the data signal both go in the same direction, viz. from the scaler S to the frame buffer FB. The input line memory inplinmem has an input clock fin and a read clock fm which is equal to the clock fm of the memory SDRAM in the frame buffer FB. Its output signal is applied to the demultiplexer MUX1 in the frame buffer FB. The demultiplexer MUX1 and a multiplexer MUX2 are required because during a burst, two samples are read from or written into the memory SDRAM in parallel. The demultiplexer MUX 1 switches at a rate fm. Both outputs of the demultiplexer MUX1 are connected to inputs of a first FIFO (FIFO1) having a write clock fm/2 and a read clock fm. Both outputs of FIFO1 are connected to inputs of a memory controller memcontr which is controlled by the SDRAM clock fm. The memory controller memcontr exchanges data with the frame buffer memory SDRAM. Both outputs of the memory controller memcontr are connected to inputs of a second FIFO (FIFO2) having a write clock fm and a read clock fout/2. Both outputs of FIFO2 are applied to inputs of the multiplexer MUX2 which switches at an output clock rate fout. In practical applications, where fout can be chosen fout=fm/2, a single clock system is obtained as then only fm needs to be generated for clocking the frame buffer FB.

A preferred embodiment of this invention also provides a solution for a single clock frame buffer with any arbitrary output clock frequency. In that case, it is required that apart from the input line memory, also an output line memory is present. With an output line memory, it is possible to send data in a burst format similar to the input bus. In this case, the horizontal blanking time can be used to compensate for the addressing overhead. Only when the blanking time is large enough to compensate fully for the addressing overhead, fm should be chosen according to fm=max(fin, fout). In that case, for the total concept, only two clocks are required. If the blanking time is not large enough to fully compensate for the addressing overhead, a three clock system is necessary.

The output line buffer cannot be integrated in the frame buffer when a gate array process is used. This means that the output line buffer should be integrated in an IC designed in a standard cell technique. It is however, very likely, that the output data of the frame buffer is sent to another IC which is designed using a standard cell technology. Such an IC is required when a look-up table (LUT) and or digital-to-analog converter (DAC) needs to be integrated. The required output line memories should also be integrated in this chip. A LUT and DA converters are often already integrated in the scaler IC. In that case, the block diagram is given in FIG. 3.

Figure 3:
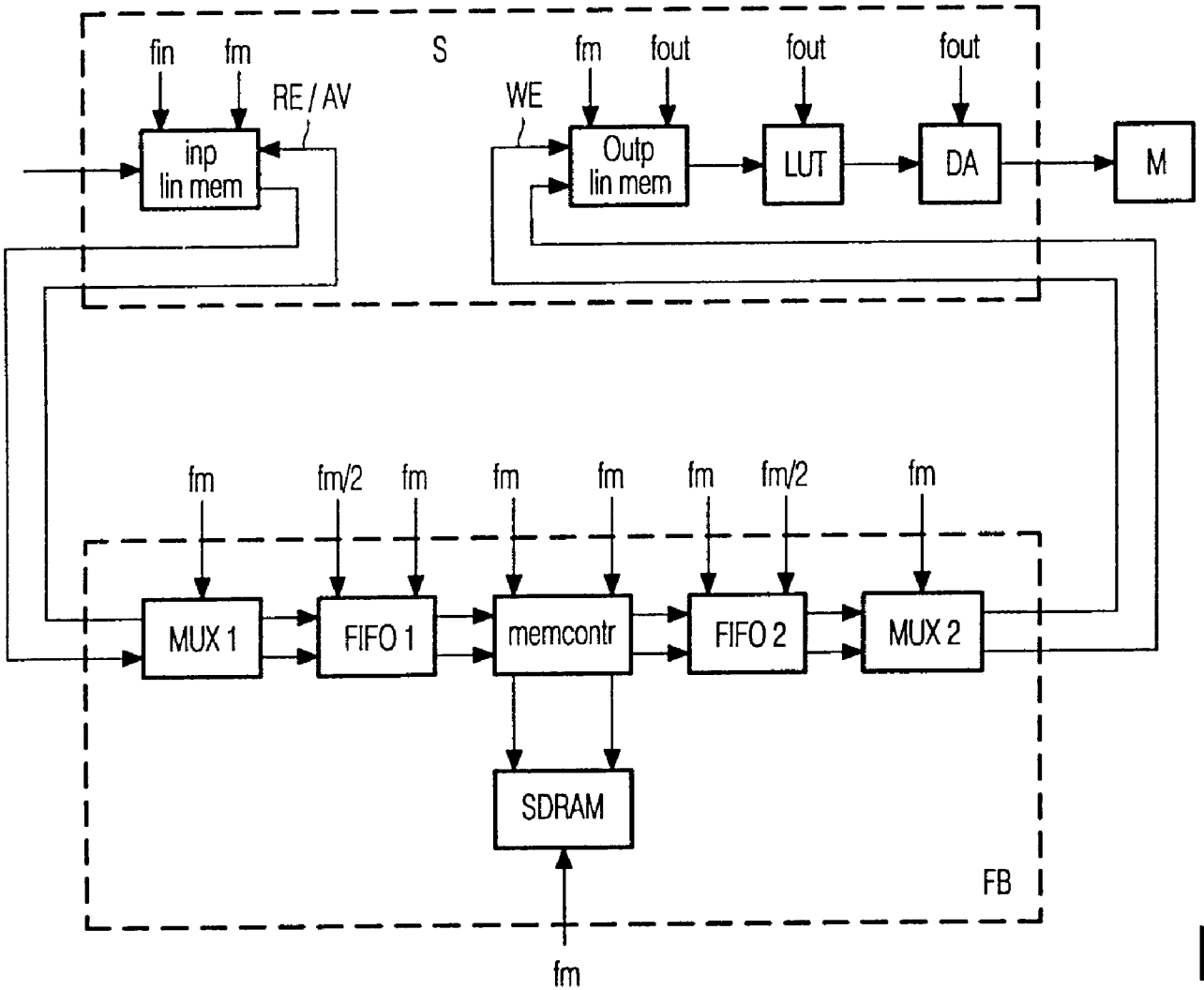
FIG. 3 shows another embodiment of the present invention.

As regards the frame buffer FB, the embodiment of FIG. 3 differs from that of FIG. 2 in that the read clock of FIFO2 is fm/2, and that the multiplexer MUX2 switches at the rate fm. A data output of the multiplexer MUX2 is connected to an input of an output line memory outplinmem in the scaler S. In addition, the multiplexer MUX2 forwards a write enable signal WE to the output line memory outplinmem. The output line memory outplinmem has fm as write clock, and fout as read clock. An output of the output line memory outplinmem is connected to an output of the scaler S thru a LUT and a DA converter which are both clocked by fout. An output of the DA converter is applied to a monitor M.

In this concept, a single clock frame buffer concept is obtained. When the horizontal blanking time is large enough, fm can be chosen as fm=max(fin, fout). This means that the scaler requires only two clock signals. In contrast to a gate array design, such as the frame buffer, in a standard cell design, such as the scaler it is also possible to integrate analog circuitry, such as a PLL. In that case no external PLLs are required anymore.

Where FIG. 2 only shows a scaler S having an input line memory inplinmem but no output line memory outplinmem, in a simple modification, the scaler S has only the output line memory outplinmem but no input line memory inplinmem. This also reduces the number of different clocks required for the frame buffer unit FB from 3 to 2, and even to 1 if the input clock fin happens to have a simple relation with the memory clock fm.

The digital interface between the scaler and frame buffer preferably does not require additional 10 pins of the scaler. The scaler preferably already has input pins for OSD and probably also a digital output. Preferably, the same pins can be used for the interface to the frame buffer. In that case, it is assumed that the frame buffer has a separate input for OSD.

It should be noted that the above-mentioned embodiments illustrate rather than limit the invention, and that those skilled in the art will be able to design many alternative embodiments without departing from the scope of the appended claims. The word "comprising" does not exclude the presence of other elements or steps than those listed in a claim. The invention can be implemented by means of hardware comprising several distinct elements, and by means of a suitably programmed computer. In the device claim enumerating several means, several of these means can be embodied by one and the same item of hardware. The invention is preferably applied in LCD projectors and other matrix displays (digital mirror device, plasma display panel, etc.), but can also be applied with other devices.

What is claimed is:

1. A memory arrangement, comprising:

a scaler unit comprising an input line memory for receiving a continuous input data stream, an input clock and a memory clock said input line memory furnishing an output data stream in which samples of two successive data bursts of N samples are situated N+ΔN samples apart from each other; and a frame buffer unit comprising memory means for receiving the output data stream from the scaler unit, said memory means being clocked by said memory clock.

2. A memory arrangement as claimed in claim 1, wherein said input line memory sends an active video indication signal to the frame buffer unit.

3. A memory arrangement as claimed in claim 1, wherein a read enable signal input of said input line memory is controlled from the frame buffer unit.

4. A memory arrangement as claimed in claim 1, wherein said scaler unit further comprises an output line memory for receiving a frame buffer unit output data stream in which samples of two successive data bursts of N samples are situated N+ΔN samples apart from each other, said memory clock and an output clock, said output line memory furnishing a continuous output data stream.

5. A memory arrangement, comprising:

a frame buffer unit comprising memory means clocked by a memory clock; and a scaler unit comprising an output line memory for receiving a frame buffer unit output data stream in which samples of two successive data bursts of N samples are situated N+ΔN samples apart from each other, said memory clock and an output clock, said output line memory furnishing a continuous output data stream.

6. A display apparatus, comprising:

a memory arrangement as claimed in claim 1; and a monitor coupled to an output of said memory arrangement.

7. A scaler unit, comprising:

means for receiving an input clock and a memory clock; and an input line memory coupled to an output of said receiving means for receiving a continuous input data stream at said input clock, said input line memory furnishing an output data stream in which samples of two successive data bursts of N samples are situated N+ΔN samples apart from each other at said memory clock.

8. A scaler unit, comprising:

means for receiving a memory clock and an output clock; and an output line memory for receiving a frame buffer unit output data stream in which samples of two successive data bursts of N samples are situated N+ΔN samples apart from each other at said memory clock said output line memory furnishing a continuous output data stream at said output clock.

9. A frame buffer unit, comprising:

memory means clocked by a memory clock; and an input for receiving a data stream in which samples of two successive data bursts of N samples are situated N+ΔN samples apart from each other at said memory clock.

10. A frame buffer unit, comprising:

memory means clocked by a memory clock; and an output for supplying a frame buffer unit output data stream in which samples of two successive data bursts of N samples are situated N+ΔN samples apart from each other at said memory clock.

* * * * *